United States Patent [19]

Baumbach

[11] 4,272,640

[45] Jun. 9, 1981

[54] AUTOMATIC SEWAGE VALVE

[76] Inventor: William J. Baumbach, Box 117, Fairfax Station, Va. 22039

[21] Appl. No.: 49,934

[22] Filed: Jun. 19, 1979

[51] Int. Cl.[3] ..... G05D 11/00

[52] U.S. Cl. ..... 137/110; 137/625.33; 137/242

[58] Field of Search ..... 137/101.19, 101.27, 137/110, 115, 625.13, 625.14, 625.18, 625.28, 625.33, 625.4, 625.48, 627.5, 630.17, 872, 242

[56] References Cited

U.S. PATENT DOCUMENTS

| | | | |
|---|---|---|---|
| 2,421,066 | 5/1949 | Howe | 137/115 |
| 2,431,640 | 11/1947 | Gordon | 137/115 |
| 2,774,371 | 12/1956 | Grannenfelt | 137/242 |
| 2,829,862 | 4/1958 | Wey | 137/242 |
| 3,017,895 | 1/1962 | Portner | 137/115 |
| 3,020,922 | 2/1962 | Oury | 137/115 |
| 3,202,165 | 8/1965 | Yavicoli | 137/115 |
| 3,470,908 | 10/1969 | Austin | 137/625.4 |
| 3,580,500 | 5/1971 | Quinn | 137/625.4 |

*Primary Examiner*—William R. Cline
*Assistant Examiner*—H. Jay Spiegel
*Attorney, Agent, or Firm*—Harvey B. Jacobson

[57] ABSTRACT

A valve installed in a sewer pipe or drain pipe extending from a house or other building to a street sewer pipe or the like which will automatically close when sewage backs up from the street sewer pipe toward the house or building structure thereby preventing back flow from the sewer pipe into the house thereby protecting the basement or other lower portions of the house or building structure from becoming flooded due to sewer backup. The valve is motor actuated and includes a vertically reciprocal gate controlled by a float operated switch structure disposed downstream of the valve to quickly and positively move the valve to fully closed position upon flood conditions existing in the lateral sewer pipe downstream of the valve thereby preventing back flow and flood conditions occurring on the house side or upstream of the valve. A motor operated pump and chopper unit communicates with the sewer pipe on the house side of the valve and discharges through a bypass line with a one-way flap valve therein to the street side of the valve in order to pump sewage around the valve when it is closed thereby enabling sewage to be discharged from the house side of the valve to the street side of the valve even when the gate valve is closed thereby enabling normal operation of the facilities in the house or other building which discharge sewage into the sewer line.

6 Claims, 6 Drawing Figures

AUTOMATIC SEWAGE VALVE

BACKGROUND OF THE INVENTION

1. Field of the Invention

The present invention generally relates to a device for controlling the back flow of sewage into a house or other building structure from which sewage is normally discharged by gravity flow through a lateral sewer pipe from the house to a street sewer pipe which can occur due to various circumstances and which is highly destructive of property and endangers the health of the occupants of the house or building. Specifically, the present invention includes an automatic valve installed in the sewer line interconnecting the house and street sewer which will automatically close and open in response to flow conditions in the sewer pipe with the valve automatically closing during flood or backup conditions due to a float operated switch structure with the valve being normally open during normal gravity flow conditions. Further, the present invention includes a bypass pump and chopper arrangement associated with the automatic valve which will enable sewage to be pumped around the valve from the house side thereof to the street side thereof thereby enabling normal use of the facilities within the house or building structure which normally gravity discharges sewage into the sewer line.

2. Description of the Prior Art

Various efforts have been made to solve the problem of sewer backup which results in sewage flooding of the basement or other areas of a house or other building structure. For example, drains have been provided with float-type ball valves, flap valves, check valves and other similar structures which enable one-way flow through a drain. One type of such flow control devices is disclosed in my prior U.S. Pat. Nos. 3,047,013, issued July 31, 1962, 3,565,106, issued Feb. 23, 1971 and 4,098,287, issued July 4, 1978. Additionally, the following U.S. patents disclose control valves, bypass pumps, and the like, associated with drain pipes, sewer lines, and the like:

U.S. Pat. Nos.
624,773—May 9, 1899
1,515,904—Nov. 18, 1924
1,708,380—Apr. 9, 1929
2,421,066—May 27, 1947
2,431,640—Nov. 25, 1947
2,519,204—Aug. 15, 1950
2,868,380—Jan. 13, 1959
2,995,142—Aug. 8, 1961
3,017,895—Jan. 23, 1962
3,020,922—Feb. 13, 1962
3,196,894—July 27, 1965
3,229,707—Jan. 18, 1966

SUMMARY OF THE INVENTION

An object of the present invention is to provide an automatic sewage valve installed in a sewer pipe or drain pipe to prevent back flow of sewage and to prevent flooding of a basement or other area of a house or building structure resulting from such back flow.

Another object of the invention is to provide a valve in accordance with the preceding object which is automatically closed in response to a float operated switch mechanism disposed downstream of the valve which would thereby sense back flow of sewage which would fill the sewer pipe thus causing the float operated switch to actuate a mechanism for positively closing the valve.

A further object of the invention is to provide a valve which includes a reciprocatory gate having wiper seals along the surfaces thereof so that when the gate is moved to an open position, the surfaces thereof will be cleaned and sealed thereby assuring that the gate will remain operative for an extended period of time and will effectively close against an interior seat for positively closing the sewer pipe.

Yet another important object of the present invention is to provide an automatic sewage valve having a bypass conduit associated therewith together with a one-way valve and a pump and chopper unit associated with the bypass conduit so that sewage can be pumped around the valve when the valve is in closed position thereby enabling those units in a house or the like which normally produce sewage to be used in the usual manner with the valve also serving to automatically open the bypass conduit when the sewer line valve is moved to a closed position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
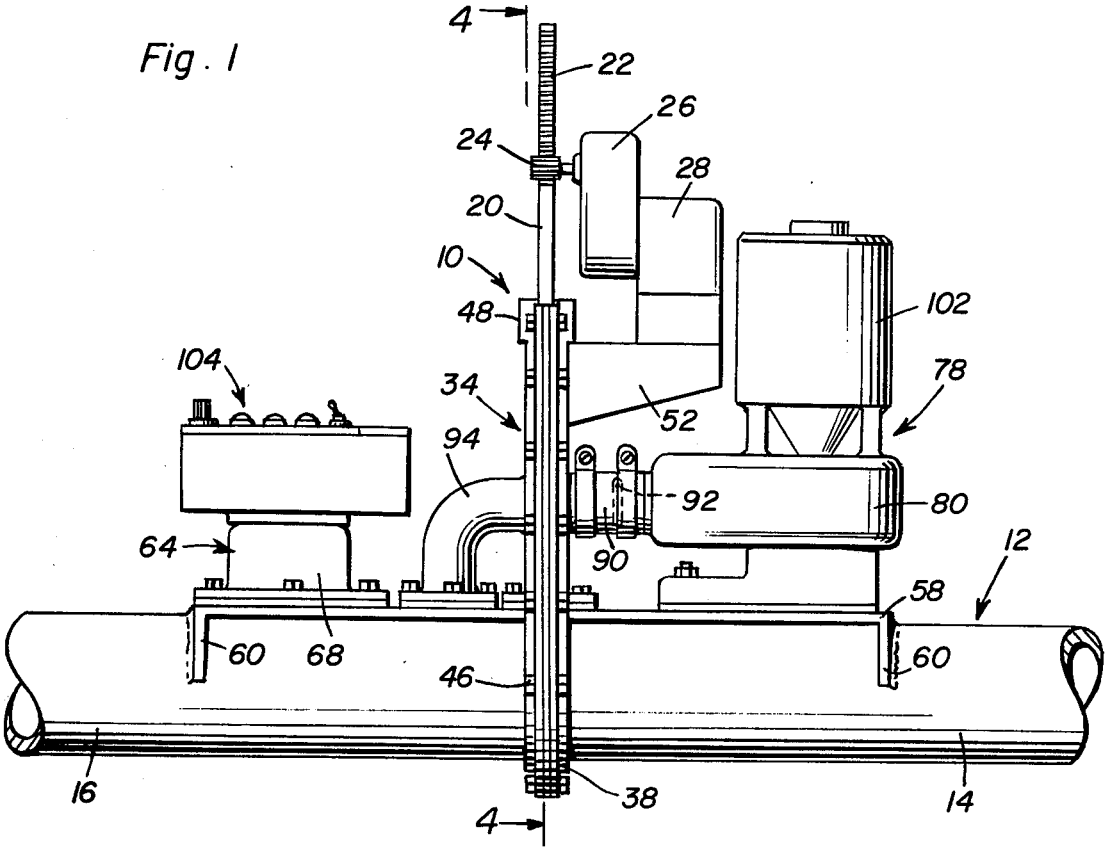
FIG. 1 is a side elevational view of a sewer pipe or line with the automatic sewage valve and bypass assembly associated therewith.
Figure 2:
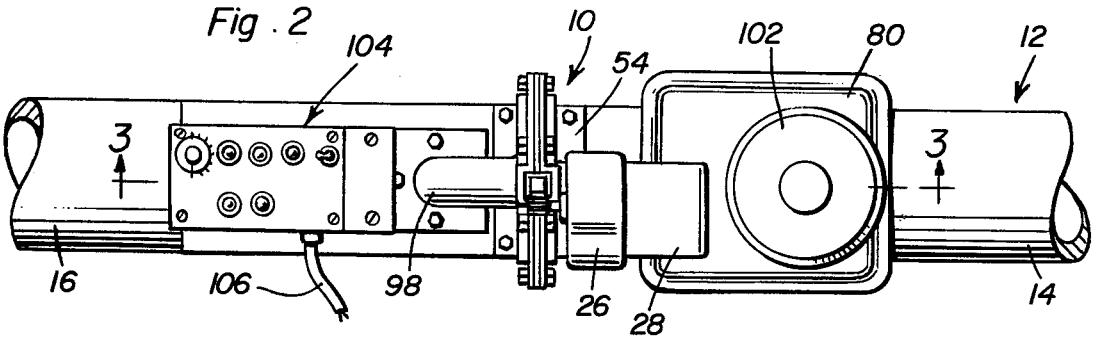
FIG. 2 is a top plan view of the structure of FIG. 1.
Figure 5:
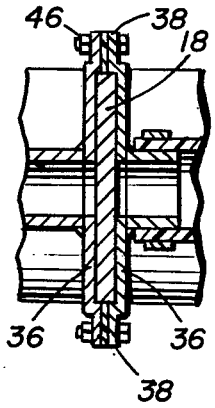
FIG. 5 is detailed sectional view taken substantially upon a plane passing along section line 5—5 of FIG. 3 illustrating further structural details of the valve structure.

Referring now specifically to the drawings, the automatic sewage valve of the present invention is generally designated by numeral 10 and is incorporated into a sewer pipe or drain pipe generally designated by numeral 12 which includes a pipe section 14 designated as the house section which is in communication with various drains, commodes and other facilities in a house or other building structure through which sewage is normally gravity discharged into a main sewer pipe or the like. The sewer pipe 12 includes a street section 16 which is downstream from the sewage valve 10 and constitutes that part of the lateral sewer pipe which extends from the sewage valve to the street sewer. The automatic sewage valve 10 may be installed at any suitable location, such as within the interior of a house alongside of the basement wall or exteriorly of the house in a suitable pit or other excavation provided therefor.

Figure 3:
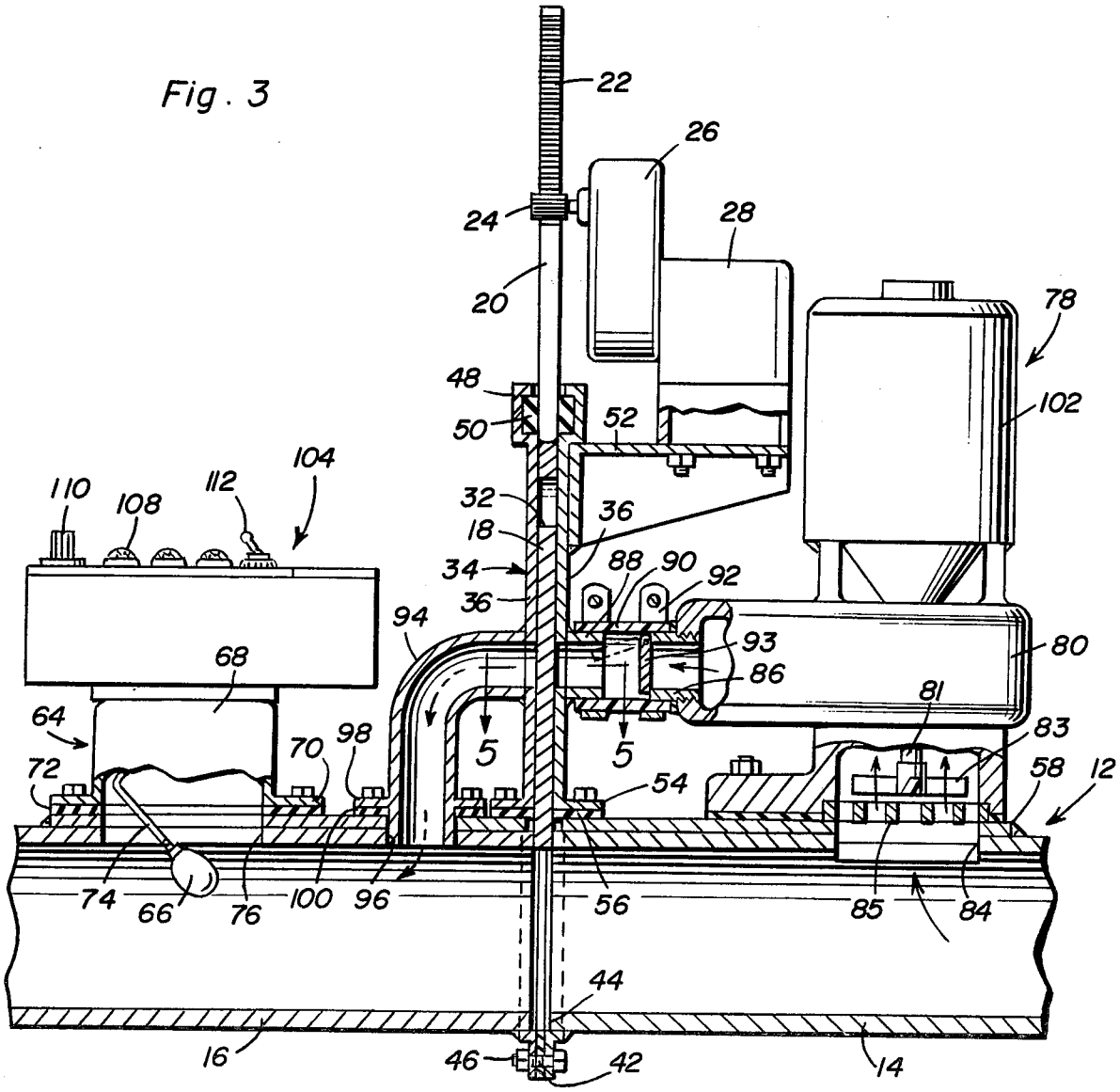
FIG. 3 is a longitudinal, sectional view taken substantially upon a plane passing along section line 3—3 of FIG. 2 illustrating specific structural details of the sewage valve and bypass assembly.

The automatic sewage valve 10 includes a vertically disposed reciprocatory plate or gate 18 having a centrally disposed elongated bar or rod 20 extending upwardly from the top edge thereof with one side edge of the bar 20 including gear teeth 22 thus forming a rack gear for meshing engagement with a drive pinion gear 24 driven by a suitable electric motor 26 having a gear reduction assembly 26 associated therewith so that when the motor 28 is actuated in one direction, the valve gate 18 will be lowered to a closed position and when the motor 28 is operated in the reverse direction, the valve gate 18 will be elevated to an open position. The reversible motor 28 and its gear reduction assembly 26 are conventional in construction and the rack gear 22 and pinion gear 24 are also conventional and the rack gear 22 may be provided with any suitable stabilizing or guiding mechanisms as deemed appropriate. The side edges of the valve gate 18 are generally parallel with the lower end edge thereof being generally semi-circular as indicated by numeral 30 and the upper end portion of the valve gate 18 includes a centrally disposed aperture 32 therein for a purpose described hereinafter. Also, the side surfaces of the valve gate 18 are parallel as indicated in FIG. 3 and are provided with a smooth surfaced finish to form a closure for the flow path between the house section 14 and street section 16 of the lateral sewer pipe 12.

Figure 4:
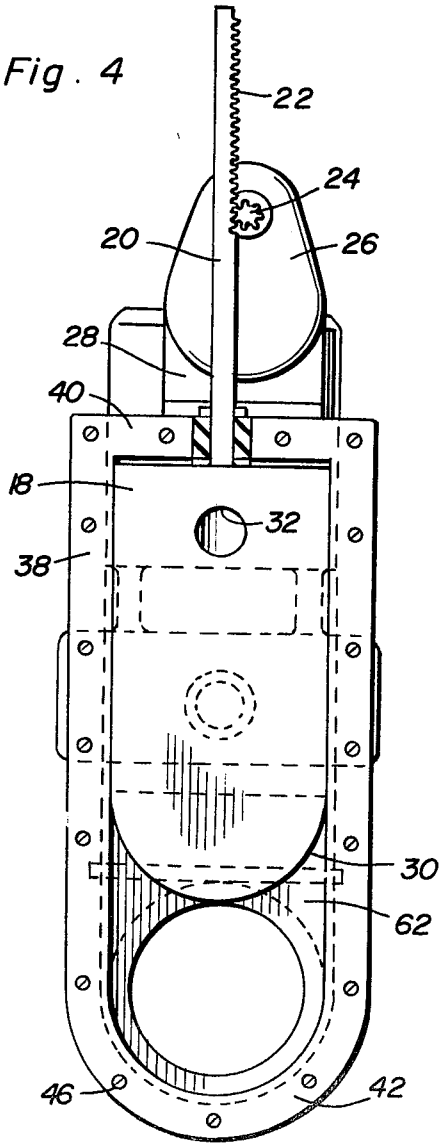
FIG. 4 is a vertical, sectional view taken substantially upon a plane passing along section line 4—4 of FIG. 1 illustrating further structural details of this invention.

The valve gate 18 is received reciprocally in a housing structure generally designated by numeral 34 and which includes spaced plates 36 which closely receive the valve gate 18 therebetween. Each of the plates 36 includes an offset flange 38 along the side edges thereof and a similar flange 40 along the top edge thereof and a semi-cylindrical flange 42 along the bottom thereof which forms a continuation of the side flanges 38 as illustrated in FIG. 4 with the flanges 42 actually being welded to the spaced ends 44 of the sewer pipe sections 14 and 16 with appropriate bolts and gaskets 46 being provided for securing the flanges together thereby providing a peripheral groove or recess in the interior of the flow path for receiving the lower edge 30 of the valve gate 18 with the edges of the valve gate 18 actually cutting through any material that may be resting on the inner surface of the sewer pipe 12.

The flanges 40 along the top edge of the plates 36 includes a recessed portion 48 receiving a sealing member 50 engaged with the elongated bar or rod 20 to preclude any leakage around the periphery of the bar 20 as it is reciprocated or in either of its positions.

The reversible motor 28 is supported on a suitable bracket structure 52 which may be rigidly affixed to one of the plates 36 of the housing 34 by any suitable means such as by welding or the like. The lower end portion of each of the side plates 36 of housing 34 is provided with a laterally extending flange 54 disposed in overlying and clamping engagement with a wiping seal 56 which has its inner edge engaged with the surfaces of the valve gate 18. The seal 56 rests on and is clamped against a supporting plate structure 58 which extends longitudinally along the top surface of the sewer pipe 12 and includes supporting gussets 60 at the outer ends thereof and filler plates 62 at the inner ends thereof which close in the area between the flat plate 58 and the periphery of the pipe sections 14 and 16, respectively. With this structure, as the valve gate 18 is elevated to a raised position, any material on the surfaces thereof will be wiped off by the wiping seal 56 engaging each surface of the valve gate 18.

In order to operate the automatic sewage valve 10, a float operated switch mechanism 64 is provided which includes a float 66 disposed in the street section 16 of the sewer pipe 12. The float controlled switch mechanism 64 includes a housing 68 mounted on the plate 58 with a peripheral flange 70 and a seal 72 with the float 66 including a support arm 74 extending up through an opening 76 in the street section 16 into the interior of the housing for closing a switch, such as a mercury switch or any other suitable conventional switch, when the interior of the street section 16 of the sewer pipe becomes filled with liquid sewage or the like thus causing the float 66 to move upwardly and thus close the switch which results in actuation of the motor 28 in a manner to lower the valve gate 18 into sealing engagement with the recess 44 thereby closing the flow path and preventing back flow of sewage into the house section 14 thereby preventing flooding of a basement or the like.

Figure 6:
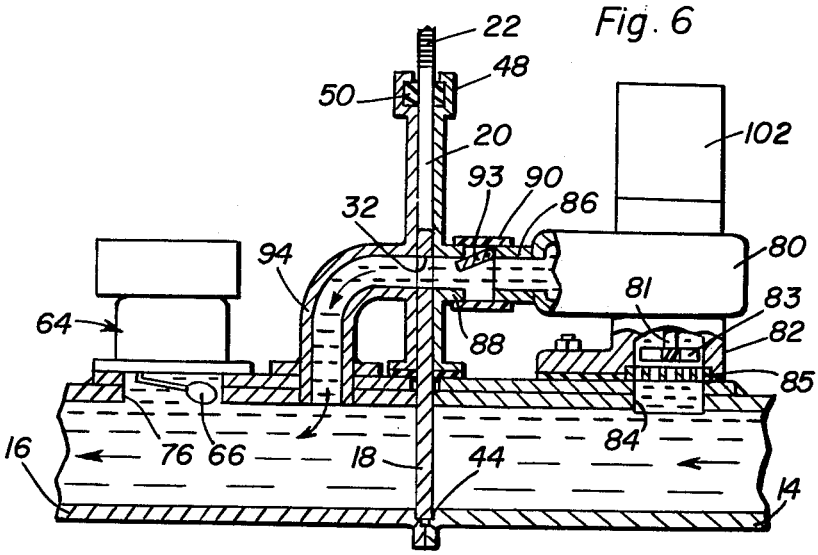
FIG. 6 is a fragmental sectional view of the bypass assembly and valve illustrating the manner in which the pump and bypass conduit are associated with the valve for pumping sewage from the house side of the valve to the street side of the valve.

A bypass assembly generally designated by numeral 78 is provided to bypass the automatic sewage valve 10 when it is closed. This assembly includes a pump 80 having an inlet fitting or adapter 82 secured to the plate 58 with a four-bladed chopper 83 being attached to the pump shaft 81 below the pump impeller (not shown). The house section 14 and plate 58 includes an appropriate seal or gasket between the adapter 82 and plate 58 and an inlet passageway 84 includes a screen or grate 85 therein which enables sewage to enter the pump 80 from the house section 14 of the sewer pipe 12. The pump 80 includes a discharge conduit 86 connected to a short conduit or nipple 88 welded to side plate 36 of the housing 34 by the use of a short flexible hose 90 and suitable clamps 92. A one-way flap valve 93 is provided in the bypass conduit which will prevent backflow therethrough in the event of pump motor failure. The other side plate 36 of the housing 34 is provided with a conduit 94 of L-shaped configuration welded thereto with the conduit extending down to and into an aperture 96 formed in the street section 16 of the sewer pipe for communication therewith with the pipe 94 including a flange 98 secured to plate 58 with a seal or gasket 100. This assembly provides a bypass around the valve gate 18 when the gate 18 is in closed position since in this position, the aperture 32 in the valve gate 18 is in alignment with and in registry with the nipple 88 and the pipe 94 as illustrated in FIG. 6 so that sewage that is normally discharged from commodes or other facilities in a house can be pumped from the house section 14 of the sewer pipe 12 around the valve gate 18 into the street section 16 so that even though the street section 16 of the sewer pipe is filled with sewage having a certain amount of back pressure, the operation of the pump will still enable the commode and other facilities to be used in the normal manner. FIG. 6 also illustrates the position of the float 66 when the street section 16 of the sewer pipe is filled with sewage or other liquid material. The pump 80 is driven by a suitable motor 102 mounted thereon and any suitable type of pump may be utilized including a centrifugal pump of any suitable type. The macerator, chopper blade 83 or the like incorporated into the intake of the impeller of the pump reduces the size of any solid particles entering the pump to enable more effective pumping of the sewage through the bypass conduit.

A control box 104 is mounted on the housing 58 or in any other suitable location with the control box 104 including an electrical conduit 106 supplying power to the control box and also for connecting the control box with the valve gate operating reversible motor 26 and the pump motor 102. The control box 104 may include an indicator light such as a green light 108 to indicate that the control box is energized. The device may receive its power from household current and a backup system may include dry cell batteries or the like mounted in the control box. The control box will also include a timer 110, a test switch 112 and other indicator lights to indicate the position of the valve gate 18 and an audible signal may be provided such as a bell or the like which will be energized when the gate 18 is closed or to indicate other conditions as deemed appropriate. With the pump being automatically energized when the gate closes and automatically deenergized when the gate opens. Various control arrangements may be provided depending upon the circumstances encountered in each installation with closing of the float operated switch serving to automatically energize the motor 26 in a direction to close the valve gate 18 in response to flood condition in the street section 16 of the sewer pipe and at the same time, the pump will be actuated for maintaining positive pressure in the bypass conduit and in the street section 16 and thereby effectively pump any sewage which flows by gravity down into the house section 14 of the sewer pipe around the valve gate and into the street section 16 of the sewer pipe. This clearly eliminates the possibility of back flow of sewage into basements or other sanitary facilities in a house or the like. Also, the device may be easily installed in existing structures as well as readily incorporated into new houses or other buildings.

The foregoing is considered as illustrated only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A valve for installation in a sewer line extending from a house or other building structure to prevent back flow of sewage into the house, said valve including a reciprocal gate mounted for movement between a closed position and an open position, a housing for said gate, said housing including wiper seal means adjacent the sewer pipe to clean the surfaces of the gate during reciprocation and to seal the gate in relation to the flow path of sewage, and means automatically moving said gate to its position in response to conditions of sewage flow in the sewer line on the downstream side of the valve in relation to the house or other building structure, bypass means associated with the valve for communicating the portions of the sewer line on each side of the valve, said bypass means including pump means for pumping sewage from the upstream side of the valve to the downstream side thereof in relation to the house when the gate closes thereby enabling sewage producing facilities in the house to be used in a normal manner when the valve is in closed position, said bypass means including a conduit, said gate including an aperture alignable with the conduit to automatically open the conduit when the gate is closed, said pump means including a chopper unit for reducing sewage particle size entering the pump means.

2. The structure as defined in claim 1 wherein said means for automatically operating the gate includes a float member mounted in the sewage flow path to be moved to a valve closing condition when the sewage in the flow path reaches a predetermined elevation commensurate with back flow conditions in the sewer line.

3. The structure as defined in claim 2 wherein said means automatically operating the gate includes a reversible motor, a rack and pinion gear drive interconnecting the motor and gate, said gate including a lower edge conforming with the inner surface of the sewer pipe.

4. The structure as defined in claim 3 wherein said pump means includes a pump having a housing with an intake opening communicating with the sewer line on the upstream side of the gate, a grate in the intake opening to limit the size of particles entering the pump housing.

5. The structure as defined in claim 4 wherein said chopper unit includes a multi-bladed chopper blade rotatably disposed in said intake opening above the grate, said pump including a shaft extending into the intake opening and drivingly mounting said chopper blade.

6. The structure as defined in claim 5 wherein said bypass means includes a conduit extending from a discharge opening in the pump housing to the sewer line on the downstream side of the valve, one-way valve means in said conduit, said gate aperture being aligned with the conduit when in said closed position and misaligned with the conduit when in said open position.

* * * * *